US009038507B2

(12) United States Patent
Thompson et al.

(10) Patent No.: US 9,038,507 B2
(45) Date of Patent: May 26, 2015

(54) DUAL PAWL RATCHET MECHANISM AND REVERSING METHOD

(75) Inventors: Christopher Thompson, Franklin, WI (US); Michael Foster, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 1310 days.

(21) Appl. No.: 11/726,263

(22) Filed: Mar. 21, 2007

(65) Prior Publication Data

US 2008/0229887 A1 Sep. 25, 2008

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 15/04; B25B 13/465
USPC ..... 81/58.1, 59.1–63.2
See application file for complete search history.

(56) References Cited

U.S. PATENT DOCUMENTS

| | | | | |
|---|---|---|---|---|
| 581,427 | A | 4/1897 | Olson | |
| 1,101,381 | A | 6/1914 | Anderson et al. | |
| 2,201,827 | A | 5/1940 | Froeschl et al. | |
| 2,981,389 | A | 4/1961 | Kilness | |
| 2,982,161 | A | 5/1961 | Angquist et al. | |
| 2,993,396 | A * | 7/1961 | Lenci, Jr. et al. | 81/63 |
| 3,436,992 | A | 4/1969 | Over et al. | |
| 3,467,231 | A * | 9/1969 | Haznar | 192/43.1 |
| 4,520,697 | A | 6/1985 | Moetteli | |
| 4,934,220 | A | 6/1990 | Slusar et al. | |
| 5,199,330 | A * | 4/1993 | Arnold et al. | 81/63.2 |
| 5,884,537 | A | 3/1999 | Chen | |
| 5,927,158 | A | 7/1999 | Lin | |
| 6,125,722 | A | 10/2000 | Hopper, Jr. et al. | |
| 6,164,167 | A * | 12/2000 | Chen | 81/63.2 |
| 6,205,890 | B1 | 3/2001 | Roberts et al. | |
| 6,357,323 | B2 | 3/2002 | Chi et al. | |
| 6,584,875 | B1 | 7/2003 | Deng | |
| 6,666,112 | B2 | 12/2003 | Hu | |

(Continued)

FOREIGN PATENT DOCUMENTS

| | | |
|---|---|---|
| GB | 2356168 | 5/2001 |
| JP | 38-001697 B | 3/1963 |

(Continued)

OTHER PUBLICATIONS

U.K. Examination Report under Sec. 18(3) of App. No. 0917121.6 issued Nov. 22, 2011 of Applicants' corresponding U.K. application.

(Continued)

*Primary Examiner* — Robert Scruggs
(74) *Attorney, Agent, or Firm* — Seyfarth Shaw LLP

(57) ABSTRACT

A dual-pawl ratchet wrench mechanism is disclosed having a stop mechanism for limiting over-travel of a reversing lever for selecting drive directions. The stop mechanism is formed on a disc is selectively engageable with first and second pawls to move the pawls into and out of engagement with a ratchet gear to determine a torque drive direction, the ratchet gear capable of providing torque to a working piece in the selected drive direction. The design simplifies manufacturing. Additionally, the reversing lever is assembled with the mechanism in a manner to improve sealing.

15 Claims, 4 Drawing Sheets

(56) References Cited

U.S. PATENT DOCUMENTS

| | | | | |
|---|---|---|---|---|
| 6,691,594 | B2 | 2/2004 | Chen | |
| 6,857,339 | B2 | 2/2005 | Chen | |
| 6,964,216 | B2 | 11/2005 | Chen | |
| 6,971,285 | B2 | 12/2005 | Chen | |
| 6,981,434 | B2 | 1/2006 | Chen | |
| 6,997,084 | B1 | 2/2006 | Gao et al. | |
| 7,044,029 | B1 | 5/2006 | Hopper | |
| 7,073,412 | B1 | 7/2006 | Arnold | |
| 7,080,579 | B2 | 7/2006 | Chen | |
| 7,082,859 | B2 | 8/2006 | Huang | |
| 7,082,860 | B2 | 8/2006 | Shu-Sui et al. | |
| 7,089,830 | B2 * | 8/2006 | Hu | 81/63.1 |
| 7,124,664 | B1 | 10/2006 | Lee | |
| 7,299,720 | B1 * | 11/2007 | Schultz et al. | 81/63.1 |
| 2002/0194965 | A1 | 12/2002 | Chen | |
| 2004/0003684 | A1 | 1/2004 | Chen | |
| 2004/0083858 | A1 * | 5/2004 | Carnesi | 81/63 |
| 2004/0089109 | A1 | 5/2004 | Chen | |
| 2004/0154439 | A1 | 8/2004 | Tuan-Mu | |
| 2004/0261584 | A1 | 12/2004 | Huang | |
| 2005/0011315 | A1 | 1/2005 | Chen | |
| 2005/0016332 | A1 | 1/2005 | Hu | |
| 2005/0092136 | A1 * | 5/2005 | Chen | 81/63.1 |
| 2005/0145076 | A1 | 7/2005 | Tuan-Mu | |
| 2005/0193870 | A1 | 9/2005 | Chen | |
| 2005/0204868 | A1 | 9/2005 | Liu | |
| 2006/0016658 | A1 | 1/2006 | Gauthier | |
| 2006/0048610 | A1 | 3/2006 | Hu | |
| 2006/0065080 | A1 | 3/2006 | Davidson et al. | |

FOREIGN PATENT DOCUMENTS

| | | |
|---|---|---|
| TW | 1221880 | 11/2004 |
| TW | 200507987 | 3/2005 |
| TW | 200517213 | 6/2005 |
| TW | 200518882 | 6/2005 |
| TW | 1258404 | 7/2006 |
| WO | WO 02/083365 | 10/2002 |

OTHER PUBLICATIONS

Taiwan Patent Office (IPO) Office Action dated Jul. 31, 2013 with English translation, 16 pgs.

* cited by examiner

DUAL PAWL RATCHET MECHANISM AND REVERSING METHOD

CROSS-REFERENCE TO RELATED APPLICATION

The present application is related to U.S. patent application Ser. No. 11/726,262, now U.S. Pat. No. 8,499,666, filed concurrently with the present application and titled "Dual Pawl Ratchet Mechanism and Reversing Method."

FIELD OF THE INVENTION

The invention relates to dual pawl ratchet mechanisms and, in particular, to an improved reversible dual pawl device and method.

BACKGROUND

Currently, many dual pawl ratchet mechanisms are known and used. Typically, these mechanisms are incorporated into handtools, such as wrenches and/or screwdrivers, or the like, so that there is a drive portion engageable with a working piece, for example, a bolt head. A first drive direction may be selected for the dual pawl ratchet mechanism so that use of the handtool provides torque when engaged with the bolt head and rotated in a first direction while slipping or ratcheting when rotated in a second direction. A second drive direction may be selected for the dual pawl ratchet mechanism that is opposite the first drive direction, and that provides torque and slip in the opposite direction.

In many environments in which these tools are used, it is common for the handtools to get dirty. The most common use of these handtools is in a work environment, such as a garage, or shop, or the like. For instance, using the handtool while working on an automobile in a garage or automotive bay often brings the handtool into contact with dirt, or oil and grease that are mixed with particulate dirt. The handtools, even when not being used, are usually stored in such environments where dirt may be floating in the air, only to settle on the handtool and become embedded in any grease or oil on the tool, as well as in any crevices in the tools. Cleaning of the handtools usually involves simply wiping the tool down.

To prevent ingress of dirt or particulate matter into the tools, attempts are made to seal the working components from the environment. However, the seals are located between working parts, so the seal itself may be exposed to the environment. Additionally, any cleaning product used on the tool must be done so carefully so as not to degrade the rubber or polymeric materials used for the seal. In some instances, a lubricating fluid may be retained by the seal, the fluid being particularly prone to degradation by contamination with particulate matter and/or by cleaning product solvents. Therefore, it is not uncommon to clean steel hand tools with a light oil, which serves to protect against rust but also promotes adhesion and ingress of the particulate matter.

In operating the reversible dual pawl mechanism, there is typically a manually actuable portion that effects the engagement of one pawl and the disengagement of a second pawl, the actuable portion being commonly referred to as a reversing lever. The drive direction for the drive portion is dependent on which of the two pawls is engaged.

The reversing lever is carried on a ratchet head or body and is movable relative thereto. Preferably, a seal is provided between the reversing lever and the ratchet head to prevent or impede ingress of particulate matter into the ratchet head where the matter could harm, ruin, or impede the proper operation of the handtool. However, the reversing lever is assembled essentially onto an outer side of the ratchet head (or in recess thereof) so that the seal is located between the bottom of the reversing lever or around its periphery. This has proved to be a less-than perfect seal for preventing ingress of matter or contaminants.

The reversing lever is typically rotated about an axis that is generally perpendicular to a face or side of the ratchet head to engage and dis-engage the pawls and, thus, to select the drive direction. The axis of rotation for the reversing lever is generally parallel to the axis of rotation of drive portion that provides the torque.

One of the problems with these handtools is the amount of rotation of the reversing lever. It is not uncommon to provide a spring and ball assembly, the spring biasing the ball into a detent, for defining the positions for the reversing lever. If the ball and detent cooperation is significant (such as due to a deep detent and spring with a high spring constant), the detent and ball can become worn or damage. On the other hand, if the cooperation is slight, the mechanism may not provide a clear tactile indication of reaching a selected position and/or may permit accidental shifting from the selected position, again leading to damage.

Accordingly, there has been a need for an improved dual pawl mechanism and reversing method.

SUMMARY

In accordance with an aspect, a reversible ratchet device such as for a reversible wrench is disclosed, including a ratchet body having a cavity therein, the ratchet body having a first side with a first body opening communicating with the cavity and having a second side with a second body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, and a reversing lever operably coupled with the pawl mechanism and received by the cavity through the first body opening, the reversing lever having an actuator portion extending through the second body opening for selecting the drive direction.

The reversible ratchet device may further include a cover plate attachable to the first side for closing the cavity, the cover plate including a plate opening allowing engagement with the drive portion. The drive portion may extend coaxially with the ratchet gear and through the plate opening in the cover plate. A seal may be provided between the reversing lever and the body. A seal may be provided between the ratchet gear drive portion and the cover plate.

The pawl mechanism may include a pair of pawls, and the reversing lever may include at least one cutout selectively engageable with a respective one of the pawls for first and second drive directions. The pawl mechanism may include a spring member positioned in biased engagement between the pawls. Each pawl may include an engagement portion, the at least one lever cut-out including first and second hook portions, the first hook portion being selectively engaged with the engagement portion of a first of the pawls in the first drive direction, and the second hook portion being selectively engaged with a second of the pawls in the second drive direction. Rotation of the reversing lever to a first position corresponding to the first drive direction may engage the first hook portion thereof with the first pawl engagement portion to move the first pawl out of engagement with the ratchet gear.

Upon rotation of the reversing lever to the first position to move the first pawl out of engagement with the ratchet gear, the spring member may bias the second pawl into engagement with the ratchet gear. The reversing lever may include a lever post portion extending through the cavity and a lever engagement portion radially extending from the lever post portion, the at least one cut-out being formed in the lever engagement portion. The lever engagement portion may be disk-like and co-axially secured with the lever post portion.

In a further aspect, a reversible ratchet device is disclosed including a ratchet body having a cavity therein, the ratchet body having a first side with a first body opening communicating with the cavity, a ratchet assembly received by the cavity through the first body opening, the ratchet assembly including a ratchet gear having a drive portion engageable for transmitting torque from operation of the device, the ratchet assembly also including a pawl mechanism having at least one pawl selectively engageable with the ratchet gear for a selected drive direction, a reversing lever operably coupled with the pawl mechanism and received by the cavity through the first body opening for selecting the drive direction, and at least one stop, wherein the pawl mechanism has at least a first engagement portion engaged with the ratchet gear in a first drive direction and a second engagement portion engaged with the ratchet gear in a second drive direction, the drive direction is selected by movement of the reversing lever between and to first and second positions, and the reversing lever cooperatively engages the at least one stop in at least one of the first and second positions.

Each stop may substantially limit the reversing lever to movement between and to the first and second positions. The at least one stop may include a first stop corresponding to the first position of the reversing lever, and may include a second stop corresponding to the second position of the reversing lever. The first and second stops may be formed on the reversing lever, and the ratchet device may include an extension portion engageable by the first and second stops of the reversing lever to define the extent of movement of the reversing lever.

The reversing lever may include an engagement extension that engages the first stop in the first position and the second stop in the second position to define the extent of movement of the reversing lever. The reversing lever may include a post portion extending through the cavity, and may include a radially extending portion including the engagement extension. The reversing lever radially extending portion may be disk-like, and the engagement extension formed radially may extend from a peripheral portion thereofto engage the first and second stops. The cavity may include an interior surface, and the first and second stops may be formed on the interior surface.

DETAILED DESCRIPTION

Figure 1:
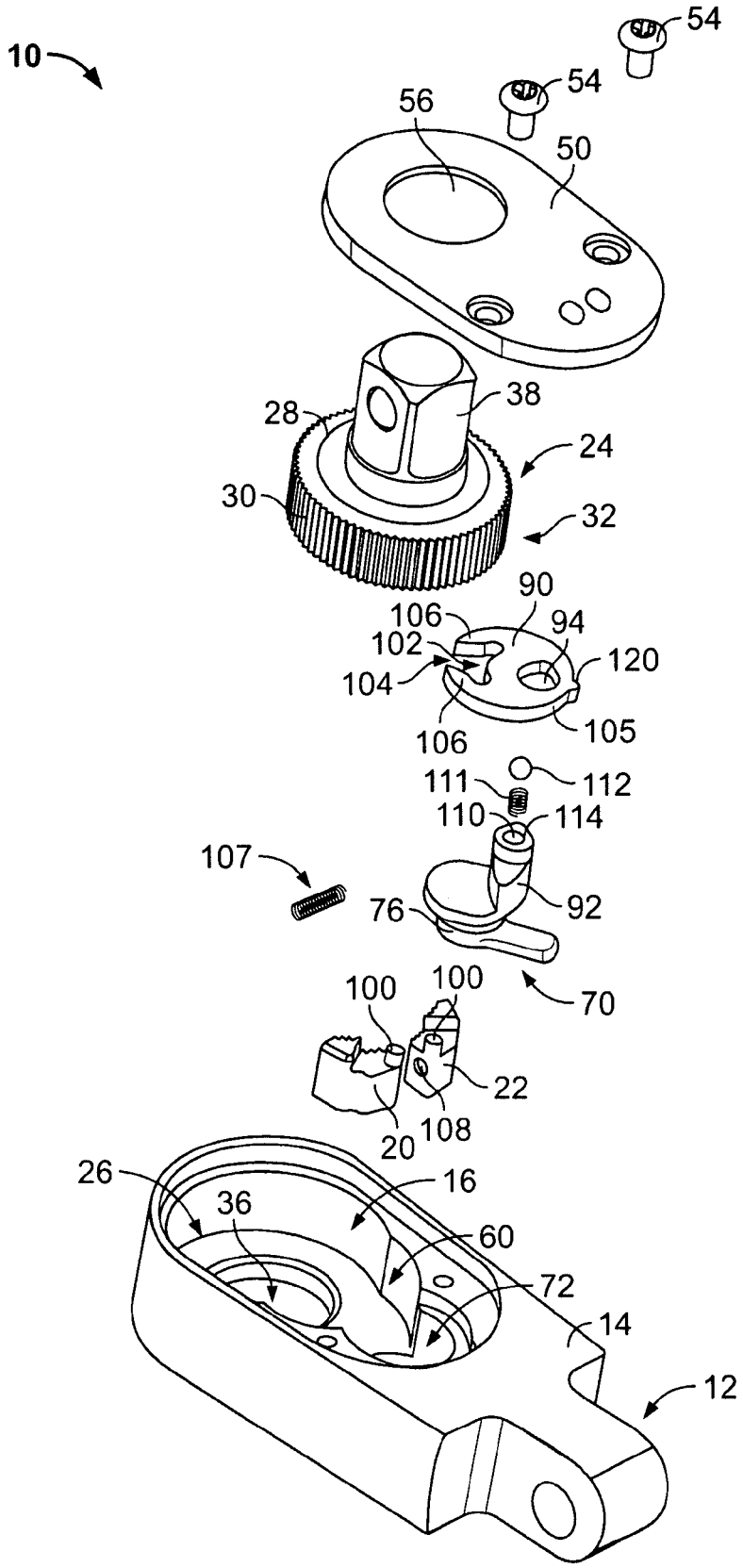
FIG. 1 is an exploded perspective view of a head of a ratchet tool in accordance with the present invention.
Figure 2:
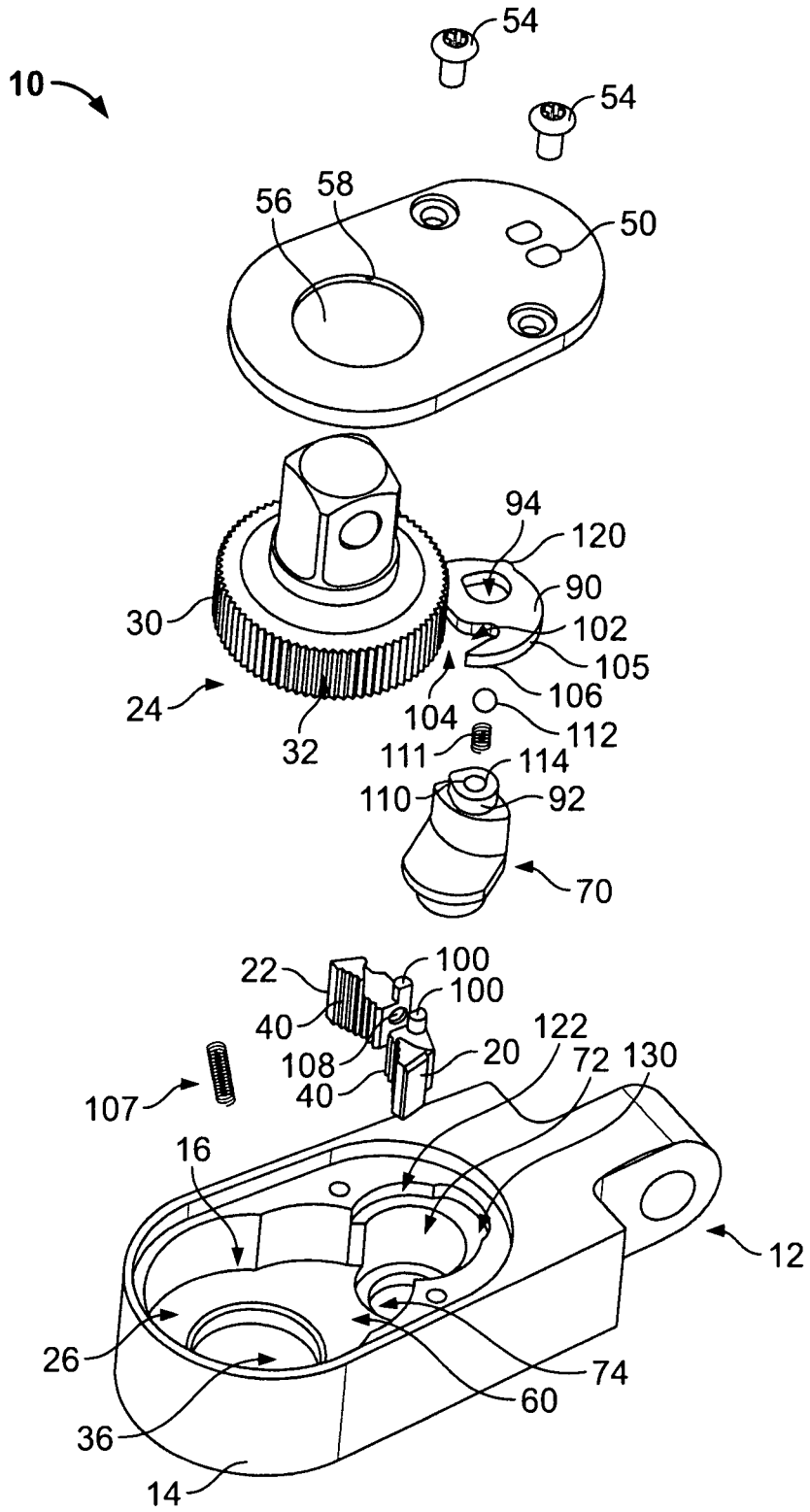
FIG. 2 is a second exploded perspective view of the ratchet tool head of FIG. 1.

Referring initially to FIGS. 1 and 2, a ratchet head 10 is depicted. While the ratchet head 10 is shown as having a connection end 12 for connecting with a yoke (not shown) on an elongated handle (not shown), it should be recognized that the ratchet head 10 may, alternatively, be integral with such a handle. The ratchet head 10 includes a body 14 including the connection end 12 and a cavity 16 for receiving internal and external components of the ratchet head 10 for providing torque to a working piece (not shown) such as a socket or other tool or a fastener.

The ratchet head 10 is of a type of ratchet known as a dual-pawl ratchet wrench allowing a user to selectively determine a torque direction. More specifically, the ratchet head 10 includes first and second pawls 20, 22 that are selectively engagable with a ratchet gear 24, the ratchet gear 24 being operatively engageable with the working piece. When the first pawl 20 is engaged with the ratchet gear 24, torque drive is permitted with rotation of the ratchet head 10 in a first rotational drive direction while slippage occurs with rotation of the ratchet head 10 in a second rotational drive direction opposite the first. Conversely, when the second pawl 22 is engaged with the ratchet gear 24, the first pawl 20 moves out of engagement with the ratchet gear 24, and torque drive is permitted with rotation of the ratchet head 10 in the second drive direction while slippage occurs in the first drive direction.

Figure 4:
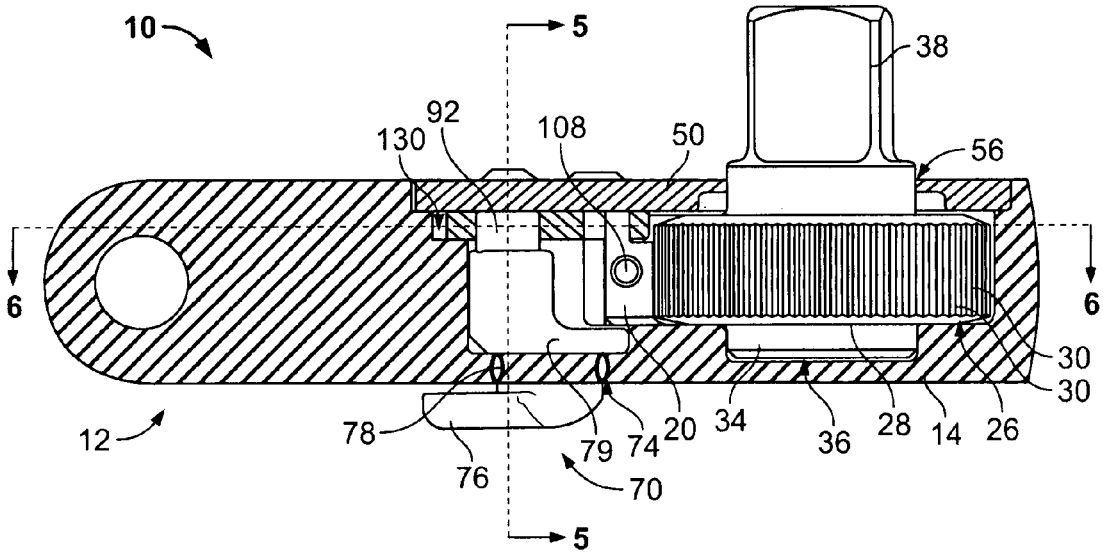
FIG. 4 is an enlarged sectional view taken generally along the line 4-4 of FIG. 3.

As can be seen, the cavity 16 includes several portions for receiving and retaining the components therein. The ratchet gear 24 is received in a first large generally circular portion of the cavity 16, referred to herein as the drive cavity 26. The ratchet gear 24 has a generally circular body portion 28 with ratchet gearing or teeth 30 on a circumferential surface 32 and has an upstanding drive post 38, which may be a drive square. The ratchet teeth 30 engage with pawl teeth 40 formed on the pawls 20, 22 for selective engagement with the pawls 20, 22 to provide drive through the drive post 38. As shown in FIG. 4, the ratchet gear 24 may also have a circular lower bearing portion 34 received in a circular recess 36 below the drive cavity 26, though this may be omitted, with the bearing portion 34 assisting in centering and retaining the ratchet gear 24 within the cavity 16. Once the ratchet head 10 is assembled, a cover plate 50 is secured with the body 14 in an upper portion 52 of the cavity 16, such as by screws 54, and the cover plate 50 includes a circular bore 56 through which the drive post 38 projects for operative engagement with a working piece. The circular bore 56 also defines a bearing surface 58 (FIG. 2) for the drive post 38 to retain and position the ratchet gear 24, best seen in FIG. 4.

The pawls 20, 22 are located in a further portion of the cavity 16, referred to herein as the pawl cavity 60, and the drive cavity 26 and pawl cavity 60 are overlapping or communicating to permit the pawls 20, 22 to move into and out of engagement with the ratchet teeth 30 of the ratchet gear 24.

Figure 3:
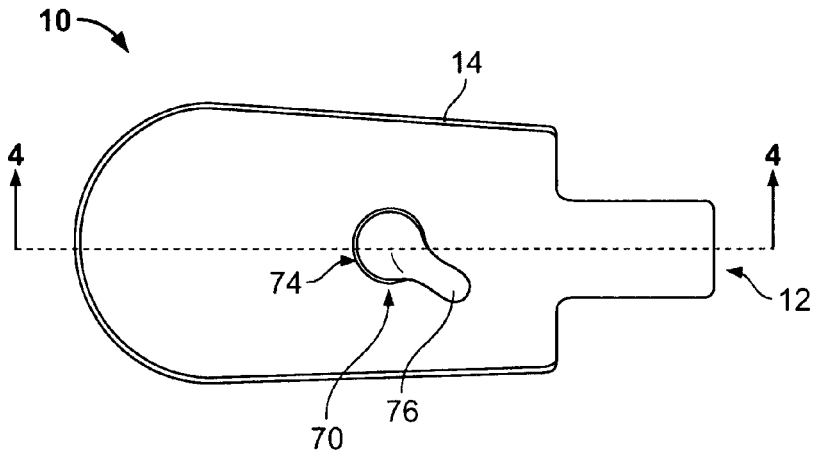
FIG. 3 is a bottom plan view of an assembled ratchet tool head of FIG. 1.
Figure 5:
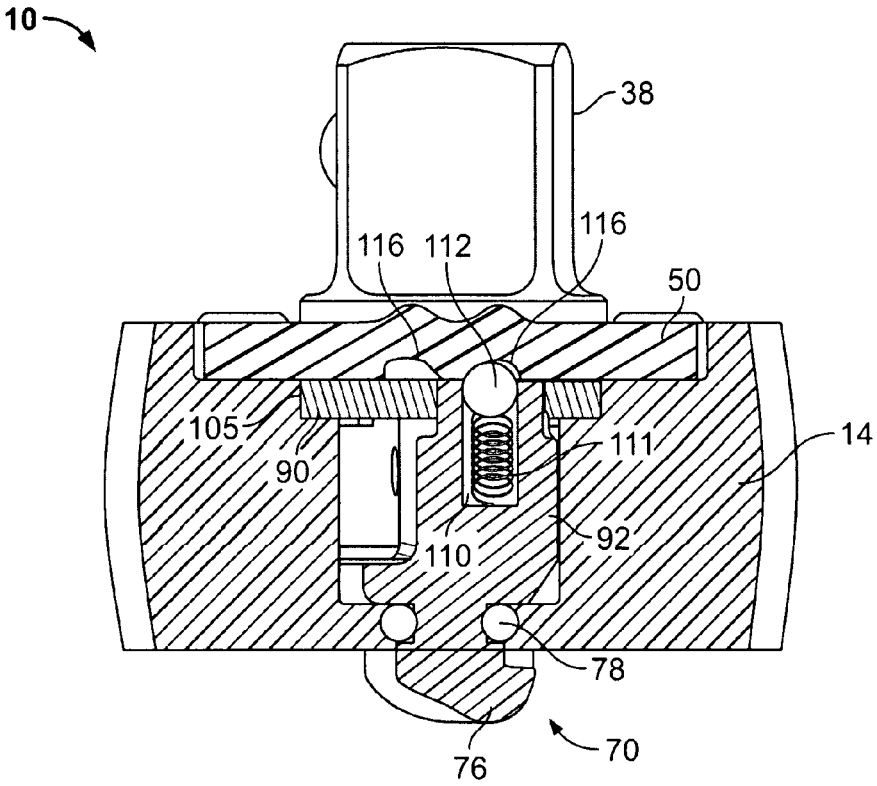
FIG. 5 is a cross-sectional view taken generally along the line 5-5 of FIG. 4.

As will be discussed in greater detail below, an actuator for selectively engaging and dis-engaging the pawls 20, 22 with the ratchet gear 24 is provided, referred to herein as a reversing lever 70. The reversing lever 70 is received in a further circular cavity portion of the cavity 16, referred to herein as the actuator cavity 72 (FIGS. 1 and 2). A throughbore 74 (FIG. 2) is provided on the bottom of the body 14 so that the reversing lever 70 may extend from the actuator cavity 72 through the throughbore 74 so that an actuator portion in the form of a lever portion 76 of the reversing lever 70 is positioned on the outside of the ratchet head 10 and is manually operated to select a drive direction by a user, as best viewed in FIG. 3. As can be seen in FIGS. 4 and 5, a seal 78 is positioned around the portion of the reversing lever 70 disposed in the throughbore 74 to impede or prevent contaminants from entering the working portions of the ratchet head 10. The reversing lever 70 is assembled with the body 14 by inserting the lever portion 76 of the reversing lever 70 into the actuator cavity 72 from a first side of the ratchet body 14 (the upper side as viewed in FIGS. 1 and 2), and by extending the lever portion 76 through the throughbore 74 to a second side of the ratchet body 14, which promotes the ability to utilize the seal 78 for preventing ingress of contaminants. The lever 70 has a portion 79 which is sized to prevent its passage through the throughbore 74, so that the lever 70 can be mounted in only one direction. The seal 78 is somewhat compressed and/or held in position between the body 14 and the reversing lever 70 and between the portions 76 and 79 of the reversing lever 70, which is itself held in position by the cover plate 50, as can be seen in FIG. 5.

Figure 6:
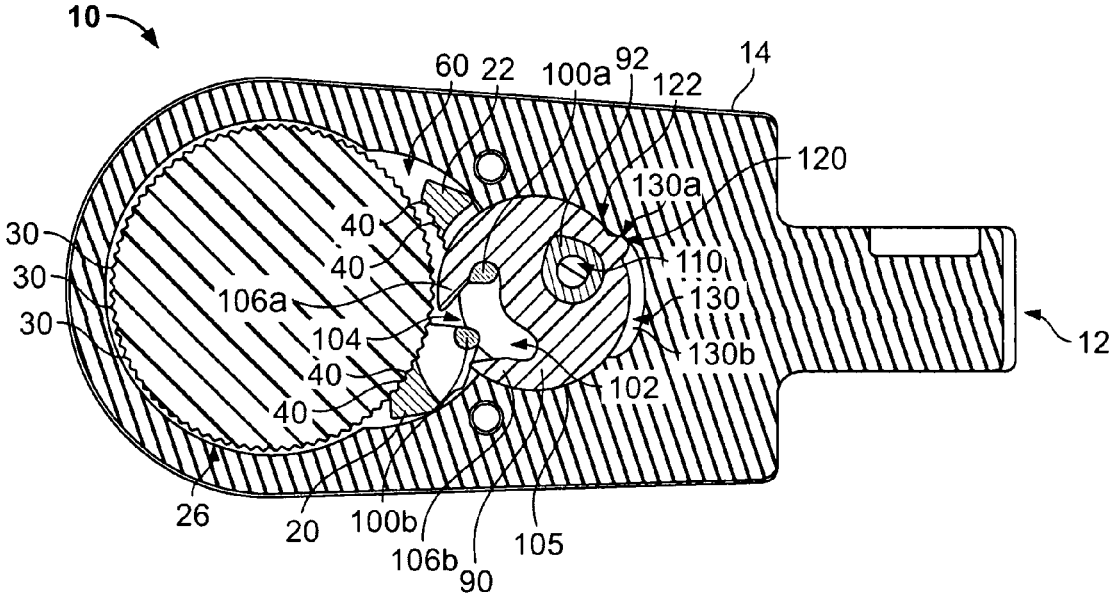
FIG. 6 is a cross-sectional view taken generally along the line 6-6 of FIG. 4.

As described, the reversing lever 70 is selectively positioned to select one of the pawls 20, 22 for selecting a drive direction. In order to effect this selection, a reversing disc 90 is positioned on an upstanding reversing lever post 92. The reversing disc 90 has an irregular bore 94, and the lever post 92 has at least a portion with a complementary shape, as best seen in FIG. 6. In this manner, when the lever post 92 is received in the bore 94, it is keyed to the reversing disc 90 so that they co-rotate when the reversing lever 70 is moved to and between positions for selecting the drive direction.

Each of the pawls 20, 22 has a selector post 100 for being manipulated by the reversing disc 90. More specifically, the reversing disc 90 has an arced cut-out 102 that communicates with an opening 104 in its radial side 105, the opening 104 and a portion of the cut-out 102 cooperating to define disc hooks 106. It should be noted that, while the cut-out 102 and opening 104 define both hooks 106, the design could easily be modified to have a pair of cut-outs and a pair of openings leading thereto. With reference to FIG. 6, as the reversing disc 90 is shifted to one position for a selected drive direction, a first hook 106*a* catches a selector post 100*a* of, for example, the second pawl 22, and continued rotation of the reversing disc 90 draws the second pawl 22 away from and out of engagement with the drive portion ratchet teeth 30, the selector post 100*a* eventually being received in the cut-out 102 as shown in FIG. 6. Simultaneously, a second hook 106*b* that was engaged with a selector post 100*b* of the first pawl 20 allows the selector post 100*b* to move from the cut-out 102 and through the opening 104 so that the first pawl 20 shifts to becomes engaged with the drive portion ratchet teeth 30, as shown in FIG. 6. A bias member such as a coil spring 107 (FIGS. 1 and 2) is positioned between the pawls 20, 22, the ends of the spring 107 being received and retained by a bore 108 formed in a side of each pawl 20, 22, the respective bores 108 of the two pawls 20, 22 being in an opposed orientation so that the spring 107 biases the pawls 20, 22 away from each other and toward engagement with the gear 24 (see FIGS. 1 and 2). In this manner, when the reversing disc 90 causes catches a selector post 100 of one of the pawls 20, 22 to move the pawl, the spring 107 causes the other pawl to shift position. Additionally, the spring 107 allows the pawl to cam or deflect away from the ratchet gear teeth 30 when a first drive direction is selected but the ratchet head 10 is rotated in reverse, in an opposite direction, to allow slippage in that direction, the spring 107 then forcing the pawl to return to engagement with the teeth 30 when such reverse movement ceases.

The ratchet head 10 is preferably designed to promote a tactile feel for a user to identify when the reversing lever 70 is in a selected one of the positions corresponding to the two drive directions. Towards this end, a ball and detent structure is provided, as is common in devices of this type. More specifically, the lever post 92 has blind bore 110 in which a spring 111 (FIG. 5) is positioned with a ball 112 positioned on the top of the spring 111, proximate an opening 114 of the bore 110. As best seen in FIGS. 1 and 6, the lever post 92 is eccentrically positioned with respect to the throughbore 74 so that the lever post 92 orbits around the center of rotation of the reversing lever 70. When the lever post 92 and reversing lever 70 are rotated, this construction allows the ball 112 to move around a generally circular path, the ball 112 contacting an underside of the cover plate 50 (see FIG. 5).

The cover plate 50, for its part, includes first and second detents 116 positioned on cover plate 50 so that they correspond to the proper position for the ball 112 when the reversing lever 70 is in the proper position for the first and second drive directions (see FIG. 5). As the reversing lever 70 is rotated out of a position for a drive direction, the ball 112 contacts an edge of one of the detents 116, thereby being deflected downward by compression of the spring 111. When the reversing lever 70 is shifted to the proper position for a drive direction, the ball 112 will move into alignment with a detent 116, and the spring 111 will force the ball 112 into the detent 116. This may produce an audible clicking sound, or may simply be felt by a user due to the variance in force required to move the reversing lever 70 in an opposite direction.

In order to promote the tactile feel, as well as to promote rotation of a proper amount, a stop mechanism is provided. In the present form, the stop mechanism is provided by structure formed on the reversing disc 90 and the ratchet body 14. However, it should be noted that the structure may be provided on any portion of the components used for reversing the direction and on any portion of the components that remain relatively stationary when the reversing lever 70 is being moved. Here, the reversing disc 90 includes a tab 120 that extends from its radial side 105. As can be seen in FIGS. 2 and 6, the reversing disc 90 positioned above and around the reversing lever 70 is received in a disc cavity 122 portion of the cavity 16, the disc cavity 122 generally closely positioned to the radial side 106 of the reversing disc 90. Thus, the surface of the disc cavity 112 also serves as a bearing surface and retains the reversing disc 90 in a proper position.

The cavity 16 further includes a stop cavity 130 in communication with the disc cavity 112 into which the tab 120 is received and position. As can be seen in FIG. 6, rotation of the reversing disc 90 to a first position for a first drive direction results in the tab 120 contacting a first stop extent 130*a* of the stop cavity 130, and it should be recognized that rotation of the reversing disc 90 from the first position to a second position for a second drive direction results in the tab 120 shifting to a second stop extent 130*b*. In this manner, over-rotation of the reversing lever 70 is prevented, and the user is provided with a positive tactile feel of full rotation.

It should also be noted that the ratchet head 10, as described, simplifies manufacturing costs and labor. The reversing lever 70 is inserted into the cavity 16 so that the lever portion 76 extends from the throughbore 74, and is sealed therewith by the seal 78. The ratchet gear 24 is inserted into the cavity 16 with the bearing portion 34 received in the recess 36. The pawls 20, 22 and the spring 107 therebetween are positioned within the cavity 16 between the reversing lever 70 and the ratchet gear 24. The reversing disc 90 is then positioned with a hook 106 around one of the pawl selector posts 100, with the reversing disc bore 94 around the reversing post 92, and with the tab 120 in the stop cavity 130. The ball 112 and its associated spring 111 are then inserted into the opening 114 of the post bore 110, and the cover plate 50 is then secured in the cavity 16, such as with the two screws 54. The reversing disc 90 is restricted from shifting upward by the cover plate 50, and from shifting downward by its cooperation with the reversing post 92. Generally, the design of the ratchet head 10 serves to retain and position each component with the ratchet body 14, with the cover plate 50, or through cooperation with one of the other components, thus minimizing the use of screws or other securements, for instance, and other manufacturing steps common to assembling dual ratchet wrenches.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A reversible ratchet device comprising:

a ratchet body having a cavity and first and second sides with respective first and second body openings communicating with the cavity;

a ratchet assembly disposed in the cavity and including a ratchet gear having a drive portion for transmitting torque to a workpiece, and a pawl mechanism having a pawl selectively engageable with the ratchet gear for allowing rotation of the ratchet gear in either of first and second drive directions, the pawl mechanism having a first engagement portion engaged with the ratchet gear when the first drive direction is selected, and a second engagement portion engaged with the ratchet gear when the second drive direction is selected;

a reversing lever having an actuator portion and a lever post, the reversing lever operably coupled with the pawl mechanism for selecting one of the first and second drive directions by movement of the actuator portion between respective first and second positions, wherein the actuator portion extends from the cavity through the second body opening, the reversing lever further including a lever post; and a reversing disc having a radially extending tab and a bore, the reversing lever coupled to the lever post at the bore, the reversing disc being selectively engageable with the pawl mechanism by movement of the actuator portion, the reversing disc having a tab extending radially from the reversing disc; and a stop formed on an inner surface of the cavity and adapted to engage the tab to prevent over-rotation of the reversing lever beyond the first and second positions.

2. The reversible ratchet device of claim 1, further comprising a cover plate attachable to the first side for enclosing the cavity, the cover plate including a plate opening allowing access to the drive portion.

3. The reversible ratchet device of claim 2, wherein the drive portion extends co-axially with the ratchet gear.

4. The reversible ratchet device of claim 2, further comprising a seal disposed between the reversing lever and the body.

5. The reversible ratchet device of claim 2, further comprising a seal disposed between the ratchet gear drive portion and the cover plate.

6. The reversible ratchet device of claim 1, wherein the pawl mechanism includes first and second pawls, and the reversing disc includes a cut-out that is selectively engageable with the first and second pawls.

7. The reversible ratchet device of claim 6, wherein the pawl mechanism includes a spring member disposed between the pawls.

8. The reversible ratchet device of claim 6, wherein the first and second pawls respectively include first and second selector posts, the cut-out forming first and second hook portions, the first hook portion being engaged with the first selector post when the first drive direction is selected, and the second hook portion being engaged with the second selector post when the second drive direction is selected.

9. The reversible ratchet device of claim 8, wherein movement of the reversing lever to the first position engages the first hook portion with the first selector post to move the first pawl out of engagement with the ratchet gear.

10. The reversible ratchet device of claim 9 wherein, upon movement of the reversing lever to the first position, a bias member biases the second pawl into engagement with the ratchet gear.

11. The reversible ratchet device of claim 8, wherein the reversing disc includes a reversing disc central axis of rotation, the lever post includes a lever post central axis of rotation, and the reversing disc is coupled with the lever post so that the reversing disc central axis of rotation and the lever post central axis of rotation are coaxial.

12. A reversible ratchet device comprising:

a ratchet body having a cavity and first and second sides having respective first and second body openings communicating with the cavity;

a ratchet assembly disposed in the cavity and including a ratchet gear having a drive portion for selectively transmitting torque in either of first and second drive directions, the ratchet assembly also including a pawl mechanism having a pawl selectively engageable with the ratchet gear for allowing rotation of the ratchet gear in either of the first and second drive directions, a first engagement portion engageable with the ratchet gear when the first drive direction is selected and a second engagement portion engageable with the ratchet gear when the second drive direction is selected;

a reversing lever movable between first and second positions and operably coupled with the pawl mechanism for respective selection of the first and second drive directions, the reversing lever disposed in the cavity through the first body opening;

a reversing disc operably coupling the reversing lever with the pawl mechanism and selectively engageable with the pawl mechanism by movement of the actuator portion, the reversing disc having a tab extending radially outward; and a stop formed on an inner surface of the cavity and adapted to engage the tab to prevent over-rotation of the reversing lever.

13. The reversible ratchet device of claim 12, wherein the stop substantially limits the reversing lever to movement between the first and second positions.

14. The reversible ratchet device of claim 13, wherein the stop includes first and second stops respectively corresponding to the first and second positions of the reversing lever.

15. The reversible ratchet device of claim 12, wherein the reversing lever includes a lever post and the reversing disc includes a bore, the reversing lever being disposed on the lever post and including a radially extending portion including the tab.

* * * * *